US007841046B2

(12) United States Patent
Fowler et al.

(10) Patent No.: US 7,841,046 B2
(45) Date of Patent: Nov. 30, 2010

(54) HEIGHT ADJUSTING APPARATUS FOR A VACUUM CLEANER NOZZLE

(75) Inventors: Michael Fowler, Normal, IL (US); Zu Gen Ni, Suzhou (CN)

(73) Assignee: Electrolux Home Care Products, Inc., Cleveland, OH (US)

( * ) Notice: Subject to any disclaimer, the term of this patent is extended or adjusted under 35 U.S.C. 154(b) by 296 days.

(21) Appl. No.: 12/153,472

(22) Filed: May 20, 2008

(65) Prior Publication Data

US 2009/0044374 A1 Feb. 19, 2009

(30) Foreign Application Priority Data

Aug. 16, 2007 (CN) ..... 2007 1 0026042
Sep. 24, 2007 (CN) ..... 2007 1 0133609

(51) Int. Cl.
*A47L 5/34* (2006.01)
*A47L 5/00* (2006.01)
*A47L 9/00* (2006.01)

(52) U.S. Cl. ..... 15/354; 15/333; 15/355; 15/356

(58) Field of Classification Search ..... 15/354–356, 15/333
See application file for complete search history.

(56) References Cited

U.S. PATENT DOCUMENTS 4,083,079 A * 4/1978 Vermillion ..... 15/354

* cited by examiner

*Primary Examiner*—Bryan R Muller
(74) *Attorney, Agent, or Firm*—Hunton & Williams

(57) ABSTRACT

The invention discloses a height adjusting apparatus for a vacuum cleaner nozzle, comprising: a barrel with a vertical passage, a groove module is formed on the inner surface of the barrel, said groove module comprises an upper groove, a lower groove, which has at least a first positioning point, a second positioning point differing from first positioning point in height and a intermediate point between the two positioning points; a resilient member, a lifting member, a driven member and a driving member are arranged in the passage of barrel from down to up. The height adjusting apparatus could be adjusted by applying a pressure force downwardly in vertical direction (for example, press by foot) and that takes less labor and time.

7 Claims, 15 Drawing Sheets

HEIGHT ADJUSTING APPARATUS FOR A VACUUM CLEANER NOZZLE

FIELD OF INVENTION

This invention relates to a mechanical height adjusting apparatus, particular to a height adjusting apparatus for a vacuum cleaner nozzle.

BACKGROUND

It is known that various different vacuums have height adjusting apparatus of nozzle housing, which typically includes a nozzle housing, the nozzle housing comprises a chassis with a suction nozzle and a suction nozzle top. The suction nozzle top is assembled with the chassis via a detachable fastener; the brush chamber is disposed on the chassis having a movable brush housed therein; the nozzle housing has a height adjusting apparatus thereof; said the height adjusting apparatus lifts or lowers the nozzle housing. Horizontal or circumferential force (such as turning the knob or horizontally sliding the switch by hand) should be applied to adjust this kind of height adjusting apparatus, however, the handle of the vacuum is away from the button or knob, when the operator intends to adjust the height of the brush of a vacuum, particular an upright vacuum, the operator should stoop down.

SUMMARY OF THE INVENTION

One object of this invention is to provide a height adjusting apparatus for a vacuum cleaner nozzle, said apparatus could be adjusted by press the press part of the apparatus that is especially suitable for pressing by foot and takes less time and labor.

One aspect of this invention is to provide a height adjusting apparatus for a vacuum cleaner nozzle comprising:

A height adjusting apparatus for a vacuum cleaner nozzle comprising:

a barrel having a vertical passage, at least one groove module communicating with said vertical passage and formed on an inner surface thereof, said groove module comprising an upper groove and a lower groove, said lower groove having a first positioning point, a second positioning point which is different from said first positioning point in a height and a intermediate point between said positioning points;

a driving member disposed in the vertical passage, having at least one upper convex rib for corresponding with the upper groove for restricting circumferential movement of the driving member;

a driven member disposed in vertical passage under said driving member, having at least one lower convex rib for corresponding with the lower groove, wherein when the driving member moves downwardly, said lower convex rib moves from the first positioning point to the intermediate point along a spiral path; when the driven member moves upwardly, the lower convex rib moving from the intermediate point to the second positioning point along a spiral path; and a lifting member, which is disposed in the vertical passage under the driven member and is adapted for engaging with a vacuum cleaner nozzle; said lifting member is driven by said driven member so as to hold a brush assembly of a vacuum cleaner nozzle, wherein a height gap between different states of the brush assembly keeps a ratio to a height gap between different positioning points; and a resilient member, which is disposed under the lifting member for supporting the lifting member;

each end of said driving member and driven member is respectively provided with a gear ring, wherein said gear rings abut against each other;

said lower groove comprises a vertical groove part restricting circumferential movement of the lower convex ribs and an annular groove part disposed under and communicated with said vertical groove part for enabling circumferential movement of the lower convex ribs;

the height adjusting apparatus comprising a plurality of groove modules, said groove modules arranged symmetrically along the circumference of the vertical passage with an amount equaling to an amount of their corresponding teeth of the gear ring, and the vertical groove parts are of different heights; said driven member is provided with lower one convex rib;

said driven member is provided with a plurality of lower convex ribs;

a depth of said upper groove is less than a depth of said lower groove, meanwhile a thickness of said upper convex rib is less than a thickness of said lower convex rib;

Another aspect of this invention is to provide a vacuum cleaner nozzle, comprising:

a nozzle housing;

a truckle frame pivotally mounted to nozzle housing for supporting said housing on a floor surface;

a height adjusting apparatus attached to nozzle housing and comprising:

a barrel attached to the truckle frame and having a vertical passage, at least one groove module communicating with said vertical passage and formed on an inner surface thereof, said groove module having a first positioning point and a second positioning point which is different from said first positioning point in a height;

an actuator member disposed in vertical passage, having at least one convex rib for corresponding with the groove module;

a lifting member which is disposed in the vertical passage under the actuator member and is adapted for lifting the nozzle housing; said lifting member is driven by said actuator member so as to hold the nozzle housing; and a resilient member, which is disposed under the lifting member for supporting the lifting member;

Wherein when the actuator member moves downwardly, said convex rib moves from the first positioning point to the second point along at least a spiral path.

said nozzle housing returns to its original position after a circulation by pressing the actuator member repeatedly;

said barrel is provided with at least two vertical notches communicated with the vertical passage on sides thereof, and the lifting member has at least two convex columns protruding outwards through the vertical notches for supporting the nozzle housing;

said nozzle housing comprises a chassis and a clapboard having a suction hole, a brush chamber is formed in front of the clapboard and a flat roof connected to the nozzle housing and arranged behind the clapboard;

a cover is mounted on the said flat roof and envelops said barrel and actuator member.

Alternatively, The vacuum cleaner nozzle may comprising:

a nozzle housing;

a truckle frame pivotally mounted to nozzle housing for supporting said housing on a floor surface;

a height adjusting apparatus attached to nozzle housing and comprising:

a barrel attached to the truckle frame and having a vertical passage, a first and second groove modules communicating with said vertical passage and formed on an inner surface thereof, said first groove module spaced from and adjacent to the second groove module;

an actuator member disposed in vertical passage, having at least one convex rib for corresponding with the groove modules;

a lifting member, which is disposed in the vertical passage under the actuator member and is adapted for lifting the nozzle housing; said lifting member is driven by said actuator member so as to hold the nozzle housing; and a resilient member, which is disposed under the lifting member for supporting the lifting member;

wherein when the actuator member moves downwardly, said convex rib moves from the first groove module to the second groove module.

said first groove module has a first positioning point, and said second groove module has a second positioning point which is different from said first positioning point in a height.

Advantages of the invention are as follow:

A height adjusting apparatus for a vacuum cleaner nozzle, which could be adjusted by applying a directly downward force (for example: press by foot) to the driving member, and takes less time and labor, simple in structure, easy in operation and suit for being applied to variant of upright or horizontal vacuums.

The present invention will be further described in conjunction with the drawings and the embodiments:

DESCRIPTION OF THE PREFERRED EMBODIMENTS

Embodiment 1

FIG. 1, FIG. 2, FIG. 3, FIG. 4, FIG. 5, FIG. 6 and FIG. 7 illustrate an embodiment of a height adjusting apparatus applied to a vacuum.

Figure 1:
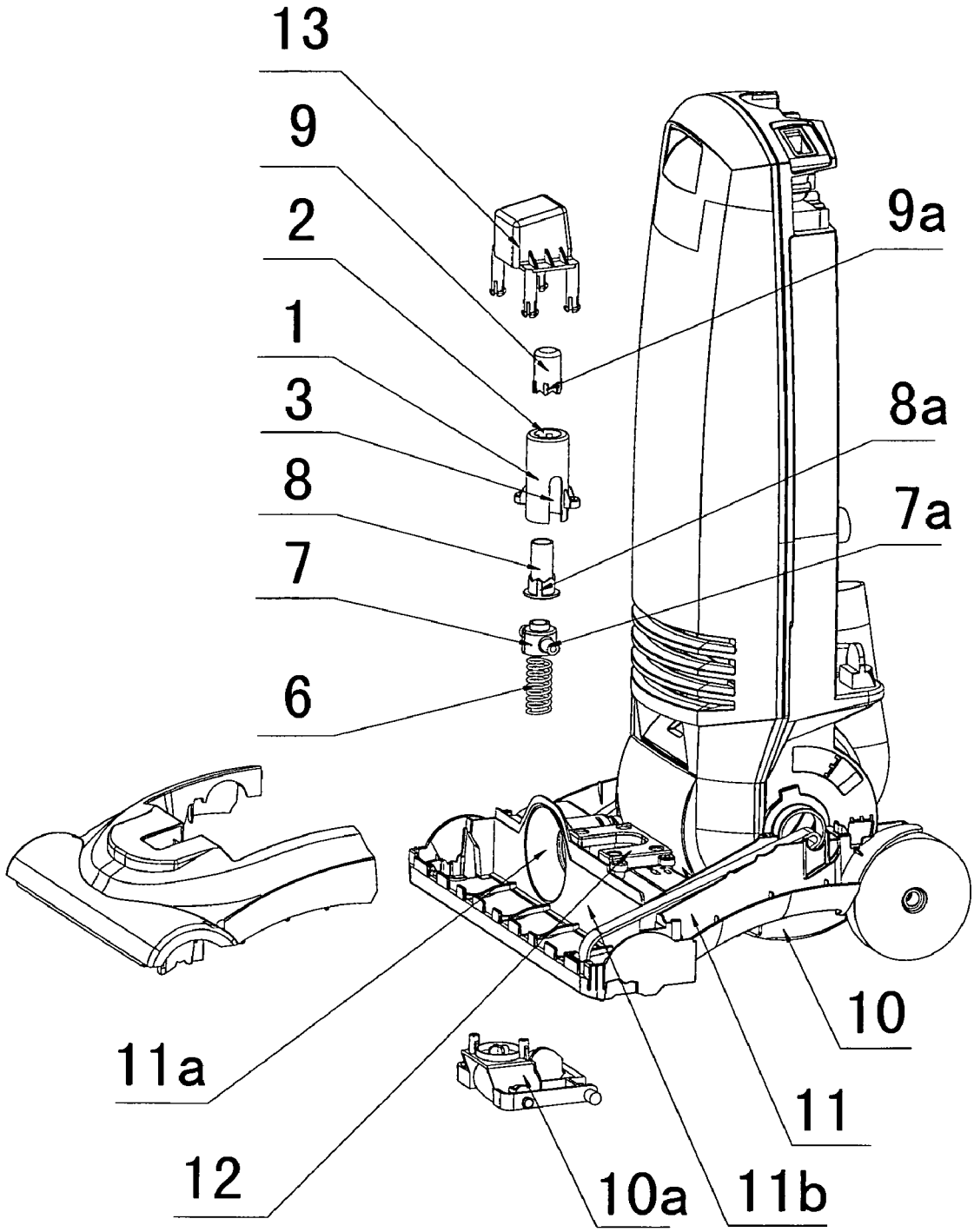
FIG. 1 is an assembly view of an embodiment of this invention.
Figure 2:
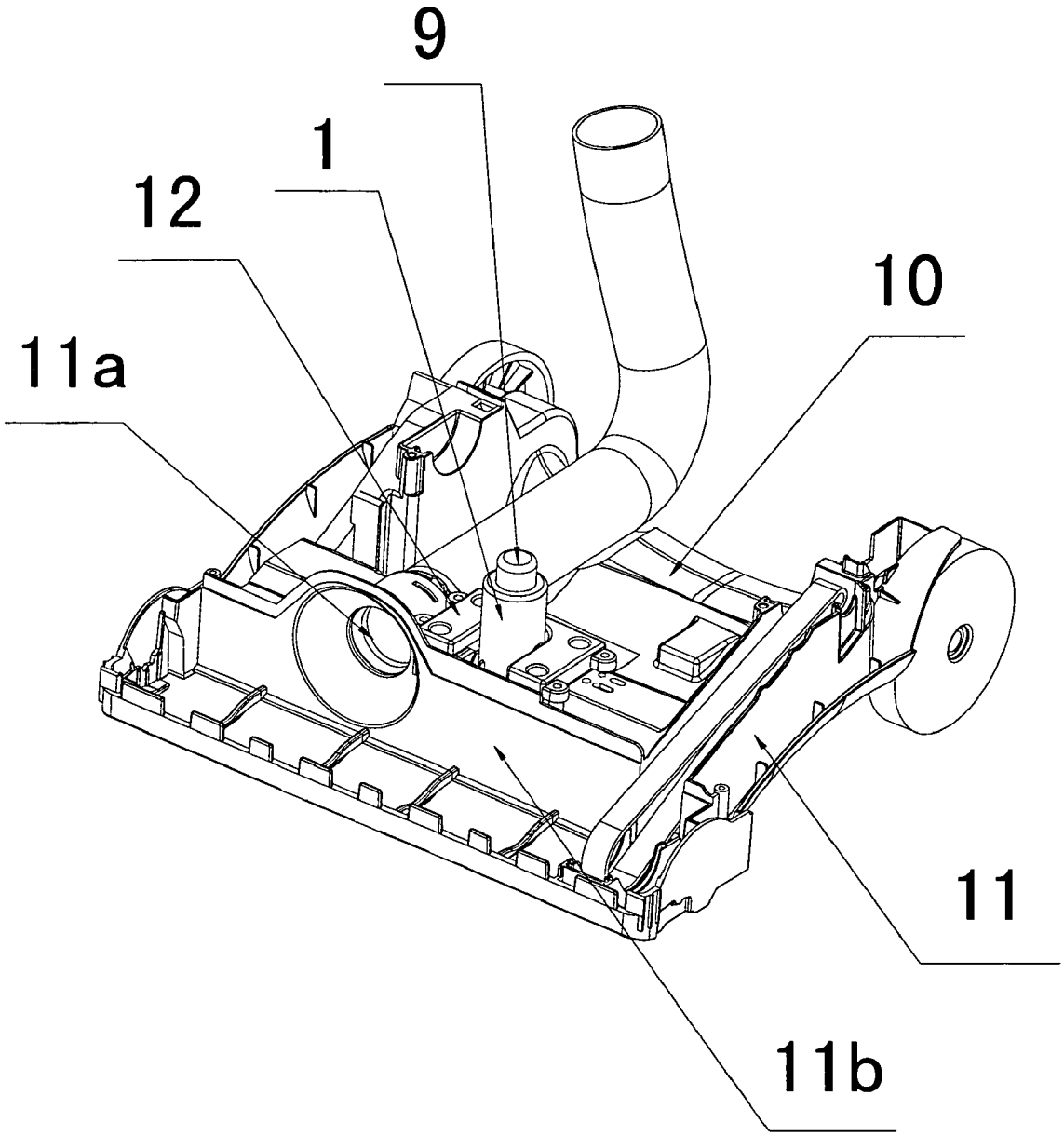
FIG. 2 is a sketch view of an embodiment of this invention.
Figure 3:
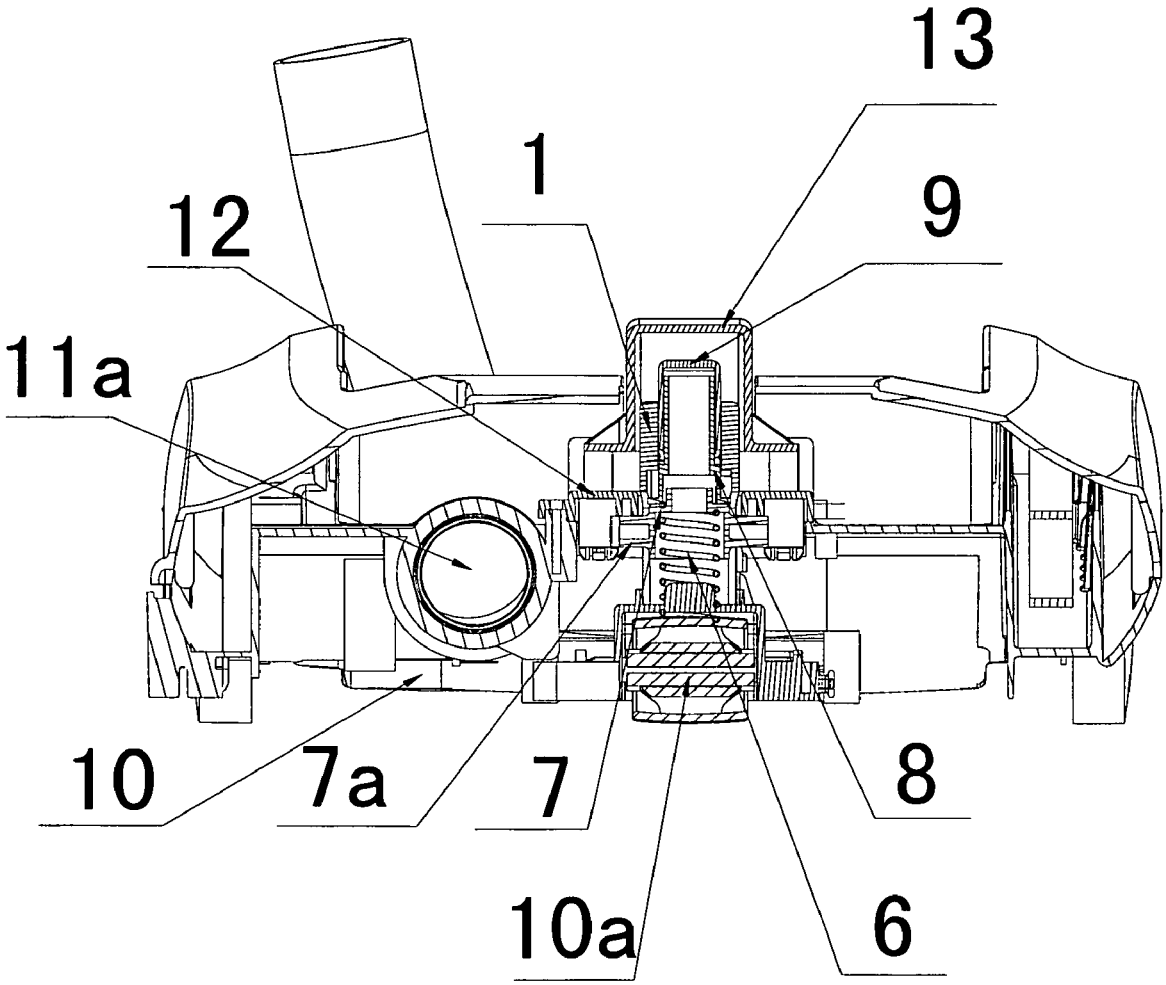
FIG. 3 is a sectional view of an embodiment of this invention.
Figure 4:
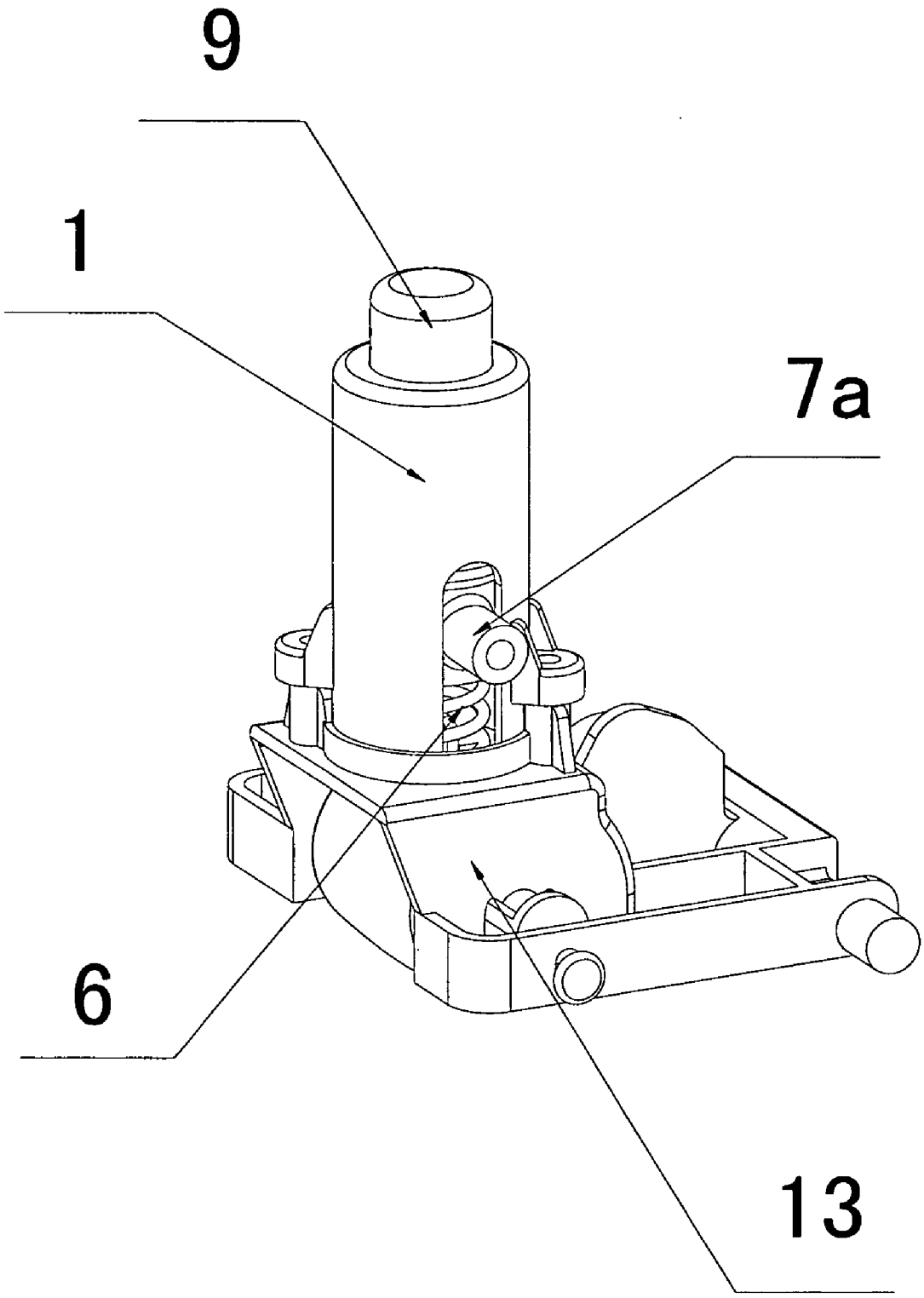
FIG. 4 is a sketch view of the height adjusting apparatus.
Figure 5:
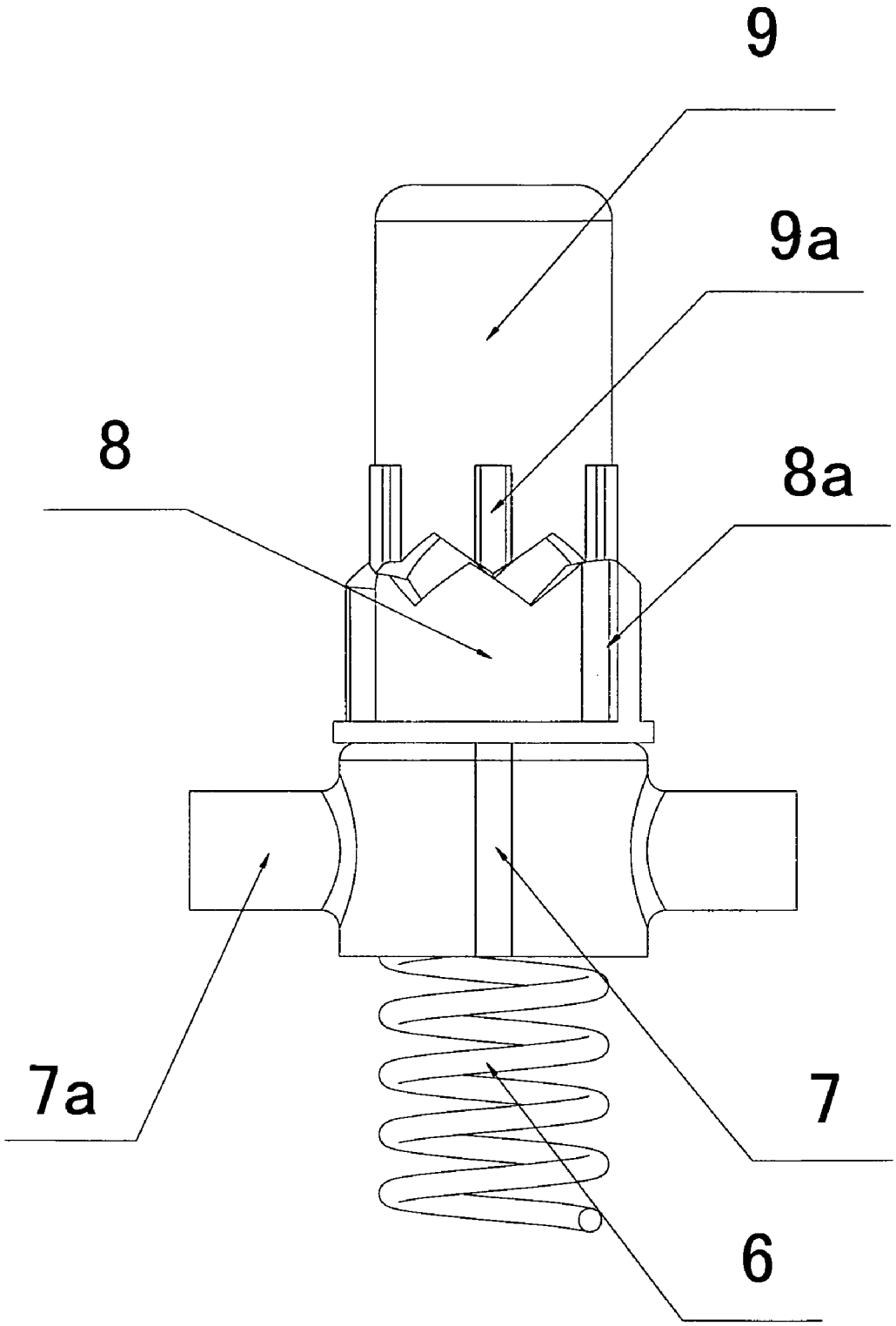
FIG. 5 is a sketch view of the component combination inside the barrel.

FIG. 1 shows an exploded view of this embodiment, a cleaner nozzle comprises a nozzle housing, a truckle frame 10*a* stands directly on the floor and is mounted to the nozzle housing via a pivot for supporting said nozzle housing, a truckle is secured to the truckle frame; said nozzle housing includes a chassis 11 with a suction nozzle and a clapboard 11*b* with a suction hole 11*a*, a brush chamber is disposed in front of the clapboard 11*b*, a flat roof is mounted on the nozzle housing behind the clapboard. The cover of the suction nozzle is connected to the chassis 11 and the main body mounted on the nozzle housing 10 will not be described here shown in FIG. 1, because they are already known as prior art. A height adjusting apparatus attached to nozzle housing comprises a barrel 1, a resilient member 6, a lifting member 7 and an actuator member, which is an assembly of a driven member 8 and a driving member 9.

In accordance with FIG. 1, FIG. 2, FIG. 3, FIG. 4 and FIG. 5, the barrel 1 has a vertical passage 2 therein and is fixed to the truckle frame 10*a*, a plurality of vertical notches 3 communicating with the passage 2 are disposed on the side wall, in this embodiment, there are two notches 3 symmetrically arranged at the left side and the right side of the barrel 1 respectively, a resilient member 6, a lifting member 7, a driven member 8 and a driving member 9 are arranged in the passage 2 of the barrel 1 from bottom to top.

Two gear rings are disposed on each ends of the driven member 8 and the driving member 9 respectively, and the teeth of the gear rings abut against each other, in this embodiment, each gear ring is provided with six teeth respectively.

The driving member 9 is provided with a plurality of upper convex ribs 9*a*, and the driven member 8 is provided with two symmetrically arranged lower convex ribs 8*a*, the lifting member 7 is provided with two convex columns 7*a*, which protrude outward through the notches 3 and push the bottom of the flat roof 12 for supporting the nozzle housing 10. The first end of the resilient member 6 is connected to the bottom of said lifting member 7 with its second end fixed to the truckle frame 10*a*. In this embodiment, a cover 13 with retractility in vertical direction is mounted on the flat roof and envelops the driving member 9 protruding from the barrel 1 for the convenience of applying pressure to the driving member 9 by the operator.

Figure 6:
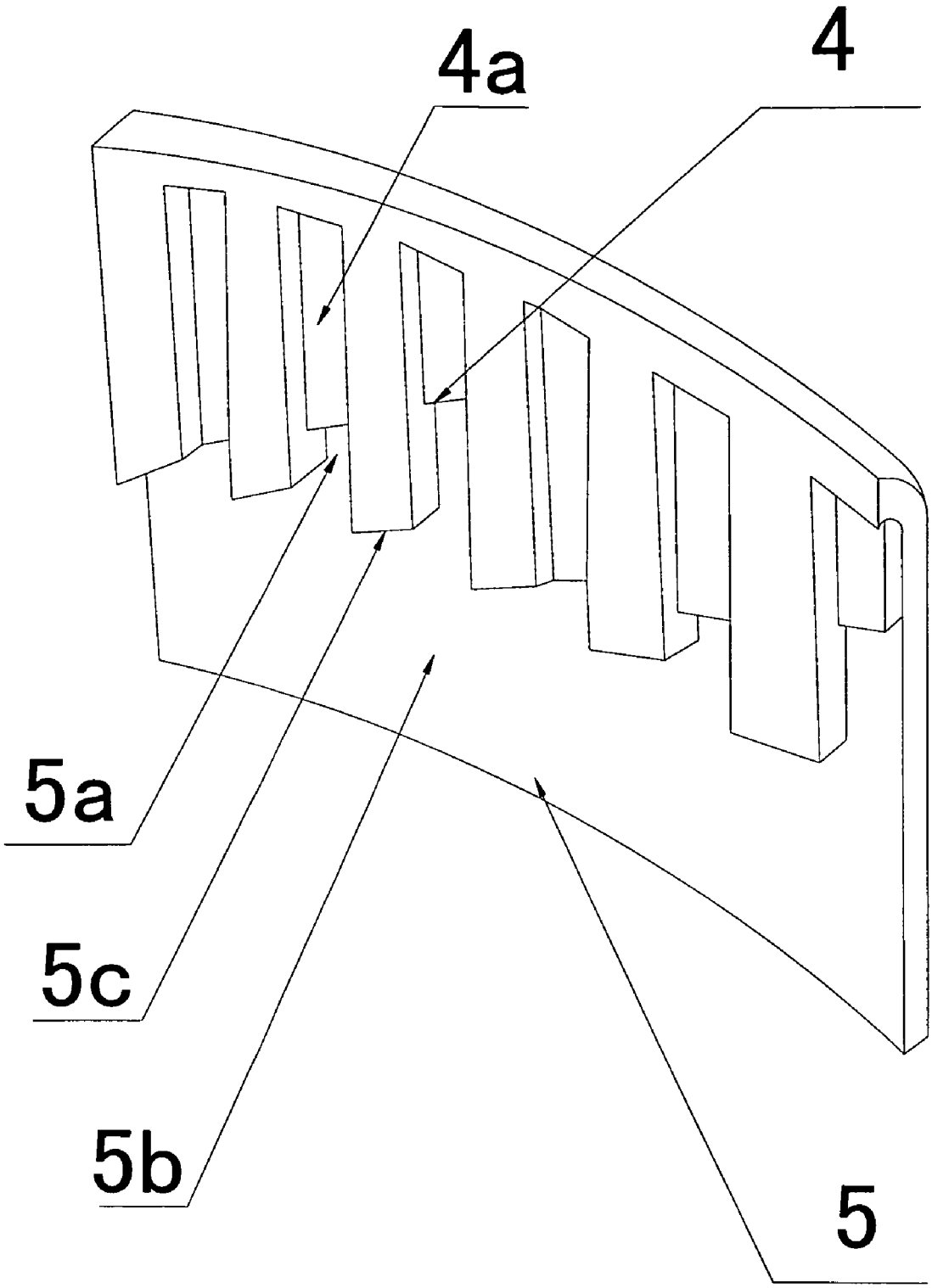
FIG. 6 is a radically unfolded perspective view of the grooves assembly in the barrel.
Figure 7:
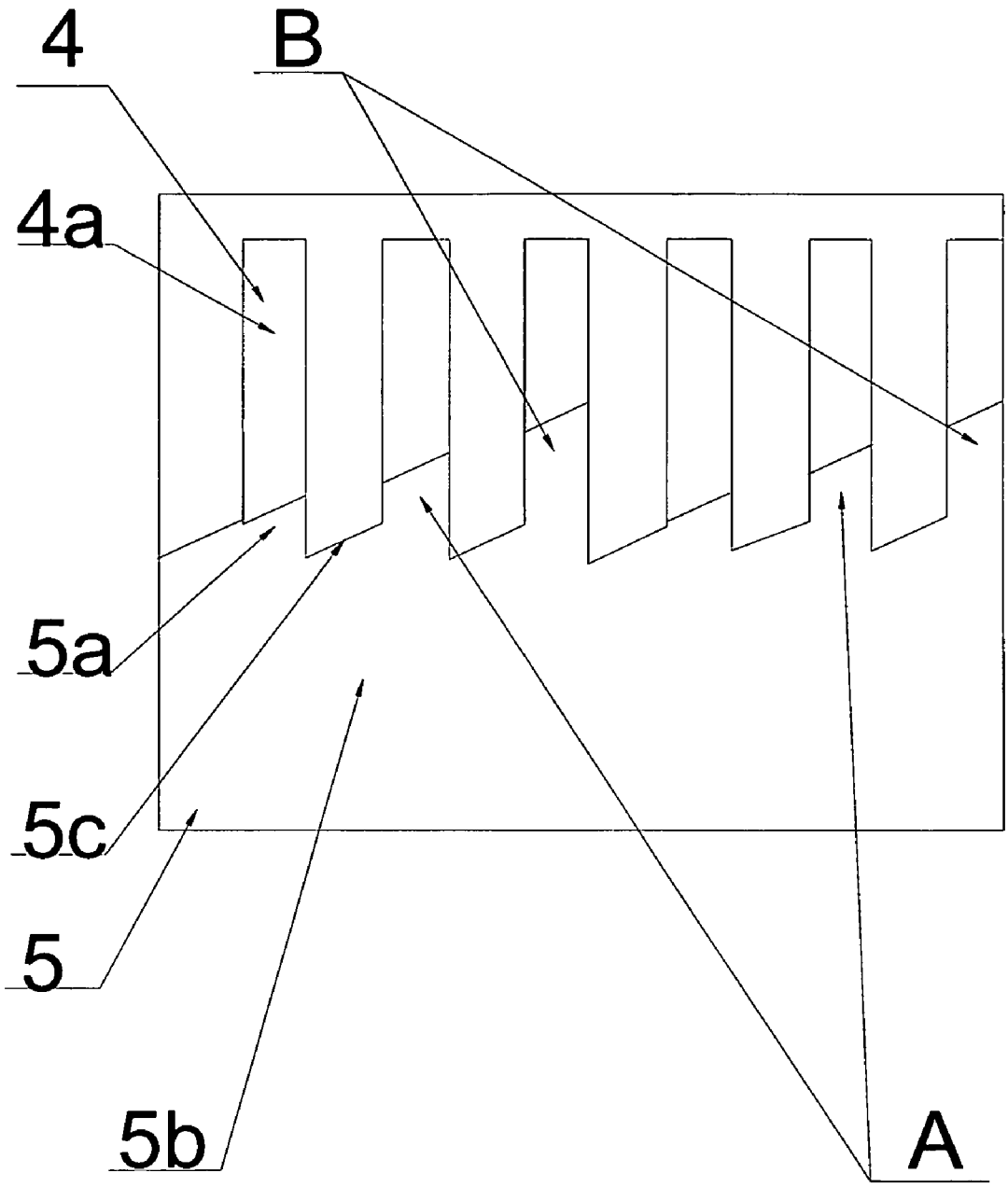
FIG. 7 is a radically unfolded plane view of the groove module in the barrel.

In accordance with FIG. 6 and FIG. 7, the barrel 1 is provided with a plurality of groove modules 4 on the inner surface, the upper groove 4*a* is adapt to the upper convex ribs 9*a*, and the amount of the upper grooves 4*a* equaling to the amount of the upper convex ribs 9*a*. The upper grooves 4*a* and the upper convex ribs 9*a* are used for restricting circumferential movement of the driving member 9, the amount of the upper grooves 4*a* and the upper convex ribs 9*a* are not limited in this embodiment.

The lower groove 5 comprises a plurality of vertical groove parts 5*a* for guiding lower convex ribs 8*a* in vertical direction and an annular groove part 5*b* enabling circumferential movement of the lower convex ribs 8*a*, the groove modules 4 are arranged symmetrically along the circumference of the vertically passage 2 with an amount equaling to the amount of their corresponding teeth of the gear ring, and the adjacent vertical groove parts 5*a* are of different heights; each annular groove part 5*b* is disposed under corresponding vertical groove part 5*a* and communicating with corresponding vertical groove part 5*a*.

A depth of the upper groove 4*a* is less than a depth of said lower groove 5, meanwhile a thickness of said upper convex rib 9*a* is less than a thickness of the lower convex rib 8*a*.

Said driven member 8 is provided with two symmetrically arranged lower convex ribs 8*a*, the barrel 1 is provided with six symmetrically arranged grooves 5*a*, any couple of symmetrical grooves are of same height, that enables the lower convex ribs to be stuck in the grooves of same height at the same time, this feature is clearly shown in FIG. 7. As shown in FIG. 7, two vertical groove parts 5*a* in a groove marked "A" are of the same height, and vertical groove parts 5*a* in a groove marked "B" are of the same height as well, however, the groove of group B is higher than the groove of group A in a height.

Figure 8:
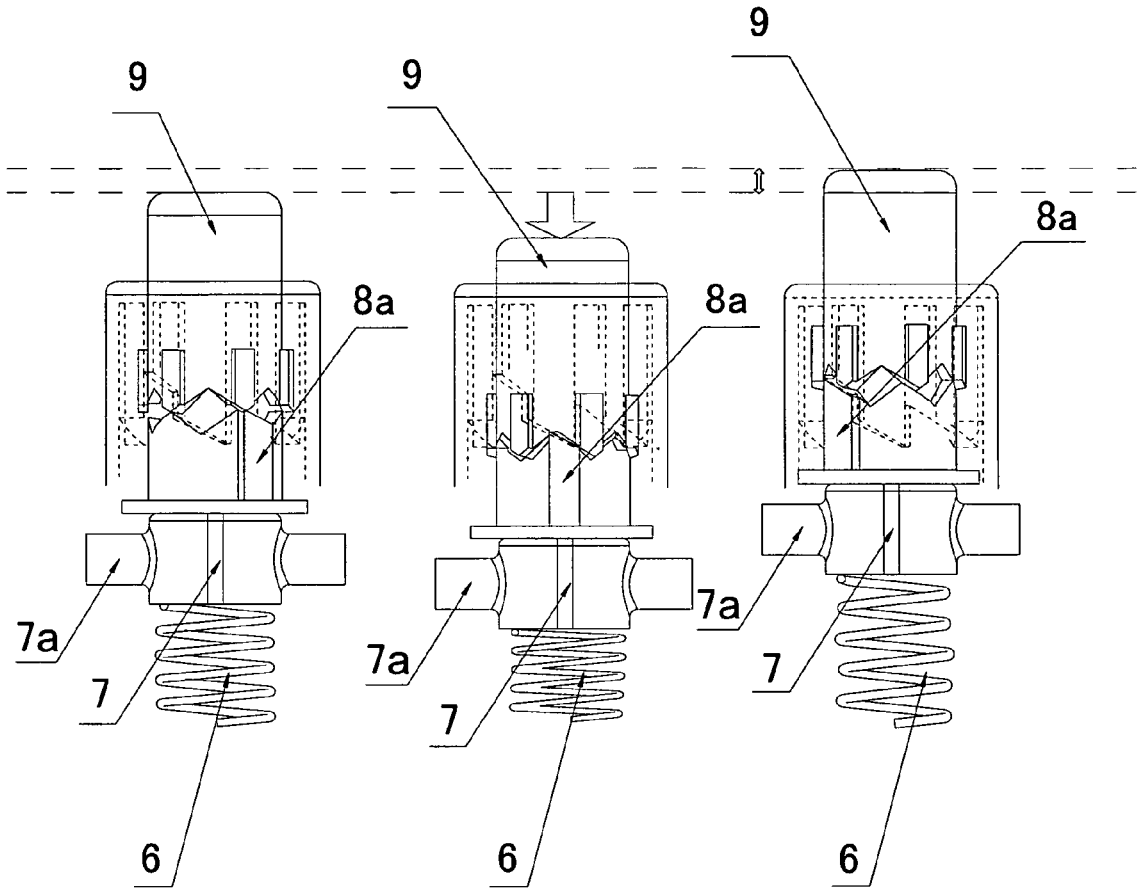
FIG. 8 shows the working process of the height adjusting apparatus.

FIG. 8 illustrates the working process of this embodiment, a completely process of pressing the driving member 9 is shown in the drawings from left to right (i.e. the gear ring of the driving member turns a pitch with regard to driven member relatively), whereof the lower convex rib 8*a* is relocated and the lifting member 7 relocated in vertical direction. The broken lines in FIG. 8 define the groove modules 4 in the interior surface of the barrel 1.

In combination of FIG. 6, FIG. 7 and FIG. 8, the working process of this embodiment is as follow:

At the initial state, no external force is employed to the driving member 9, the teeth of the gear ring of the driving member 9 abut against the teeth of the gear ring of the driven member 8. Because of the pre-stressing force of the resilient member 6, the lower convex ribs 8*a* of the driven member 8 are stuck in a certain couple of the vertical groove parts (corresponding to vertical groove parts A in FIG. 7), the lifting member 7 holds the nozzle housing 10, and keeps the nozzle housing 10 at its initial state.

When a downward fore is applied to the driving member 9 from the cover 13 pressed by an operator, the driven member 8 is driven by the driving member 9, because of the restriction of the upper groove 4*a*, the driving member 9 moves downwardly in vertical direction, when the gear ring of the driving member 9 is engaging with the gear ring of the driven member 8, the driven member 8 is forced to descend from a first positioning point to a intermediate point along a linear path. However, with the restriction of the vertical groove parts 5*a*, the lower convex ribs 8*a* are unable to rotate; After being entirely pushed out of the vertical groove parts 5*a* group into the annular groove part 5*b*, the driven member 8 start to turn with the lower convex ribs 8*a* along the guiding surface 5*c* (i.e. the intermediate point between two positioning points).

Obviously, when the gear ring of the driving member 9 is fully engaged with the gear ring of the driven member 8, the driven member 8 stops turning, since the resilient member 6 has been compressed by the driven member 8, the driven member 8 is pushed upwards by the restoration force of the resilient member 6 when the push force to the driving member is withdrawn. With the guide of the guiding surface 5*c*, then the lower convex ribs 8*a* moves from the intermediate point to a second positioning point along a spiral path in order to ascent and rotate about its axis. So the driven member 8 pushes the driving member 9 upwards, the two gear rings are disengaged due to the restriction of the upper convex ribs 9*a*. After that, the lower convex ribs 8*a* move into the next vertical groove part 5*a*, the tooth of the gear rings abut against to each other again, i.e. the two gear rings moved a pitch relatively. Finally, the lower convex ribs 8*a* enter into the next couple of vertical groove parts 5*a* (corresponding to vertical groove parts B in FIG. 7) and get stuck respectively. Because the vertical groove parts A are higher than vertical groove parts B, the nozzle housing moves up by a certain distance keeping a ratio to the height gap between vertical groove parts A and vertical groove parts B along with the lifting member 7.

If an external pressure is applied to the cover 13 repeatedly to push the driving member 9 and drives the gear ring of the driven member 8 to rotate once with respect to the gear ring of the driving member 8, the nozzle housing 10 returns to its initial location after a circulation.

The technical solution of this invention to be protected is not limited to the above-mentioned embodiment.

Embodiment 2

FIG. 9, FIG. 10, FIG. 11, FIG. 12, FIG. 13 and FIG. 14 illustrate another embodiment of a height adjusting apparatus of this invention comprising a chassis 14, which has a brush chamber, a suction nozzle top 22 assembled with said chassis, a brush seat 15 and a height adjusting apparatus connected to the chassis, said height adjusting apparatus includes a pivot 16, a swing body 17, a intermediate member 19 and a limiter 21.

Figure 9:
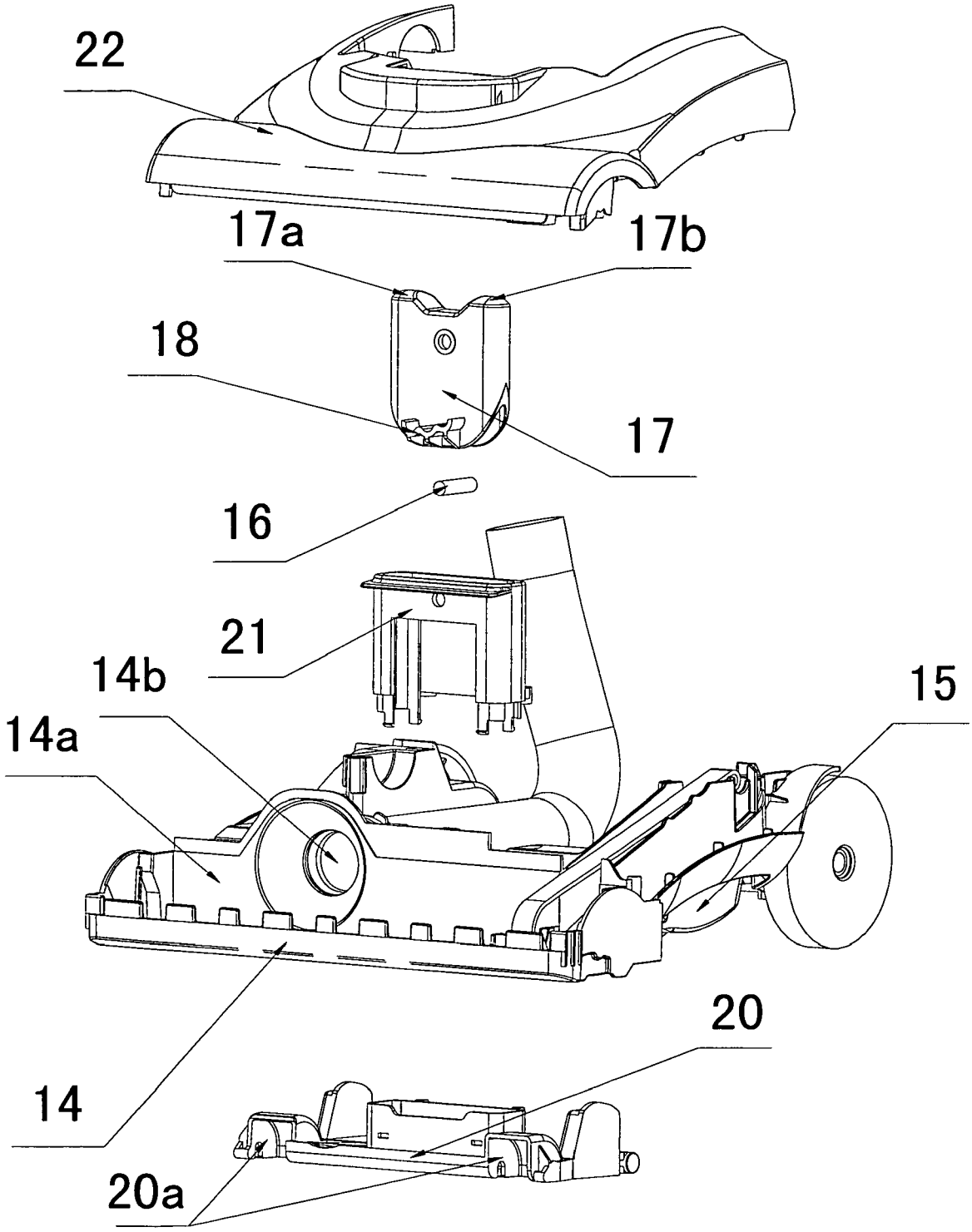
FIG. 9 is exploded view of another embodiment of the height adjusting apparatus.

The brush seat 15 is provided with a detachable plate 20, said limiter 21 is connected to the plate via a fastener, the plate 20 is provided with two truckle frames 20*a* having a truckle respectively, as shown in FIG. 9. The upper part of the swing body 17 is mounted in the upside of the limiter 21 via said pivot.

Figure 14:
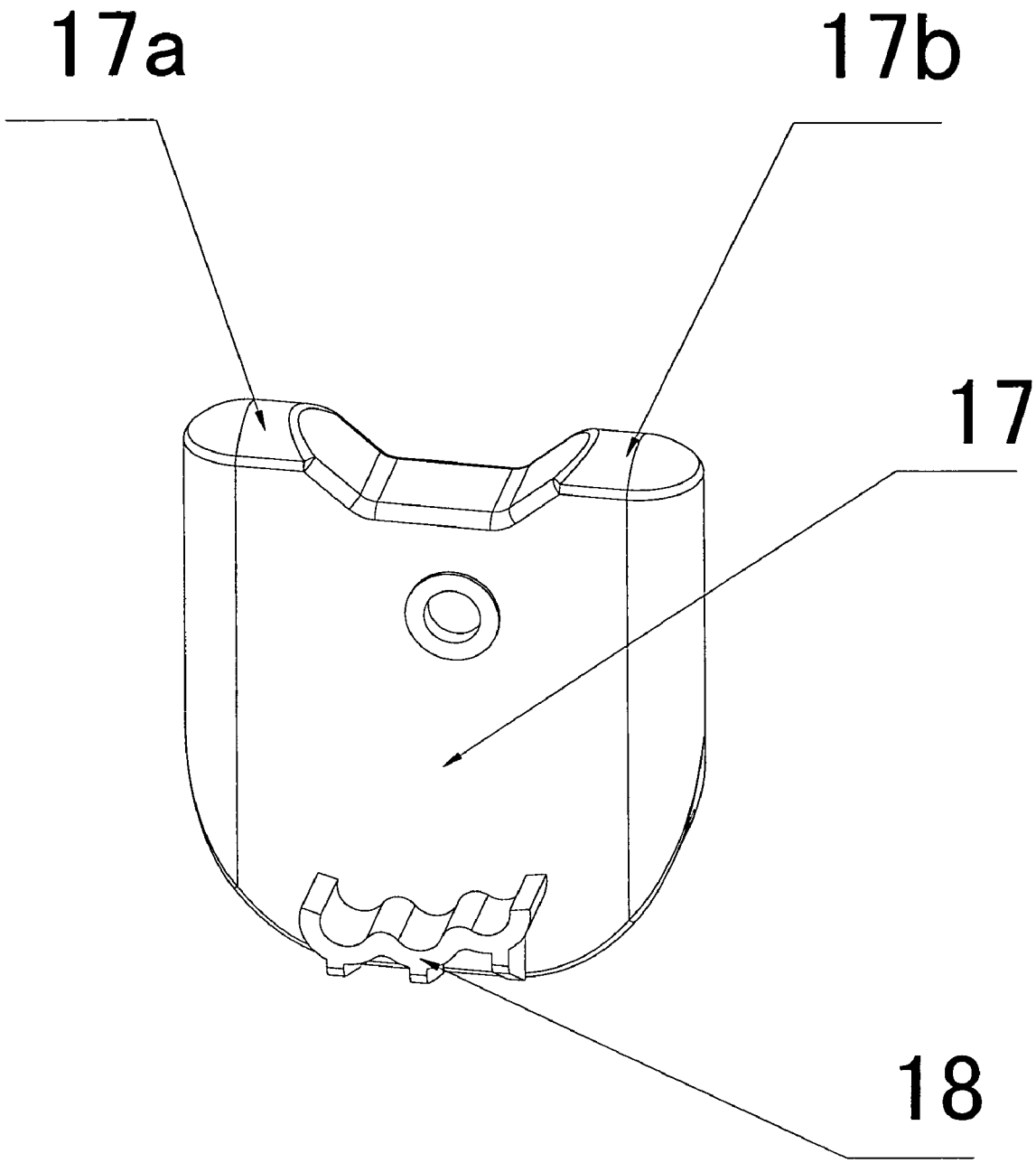
FIG. 14 is a sketch view of the swing member shown in FIG. 9.

FIG. 14 illustrates the swing body 17, provided with two press parts—left press part 17*a* and right press part 17*b* arranged at the both sides of the pivot hole for receiving a pivot 16. The swing 17 body could rotate about the pivot 15 by pressing the press part 17*a* or 17*b*. A corrugated plate 17 having three concaves wherein the right concave is higher than the left is formed at the lower portion of the swing body 17.

Figure 11:
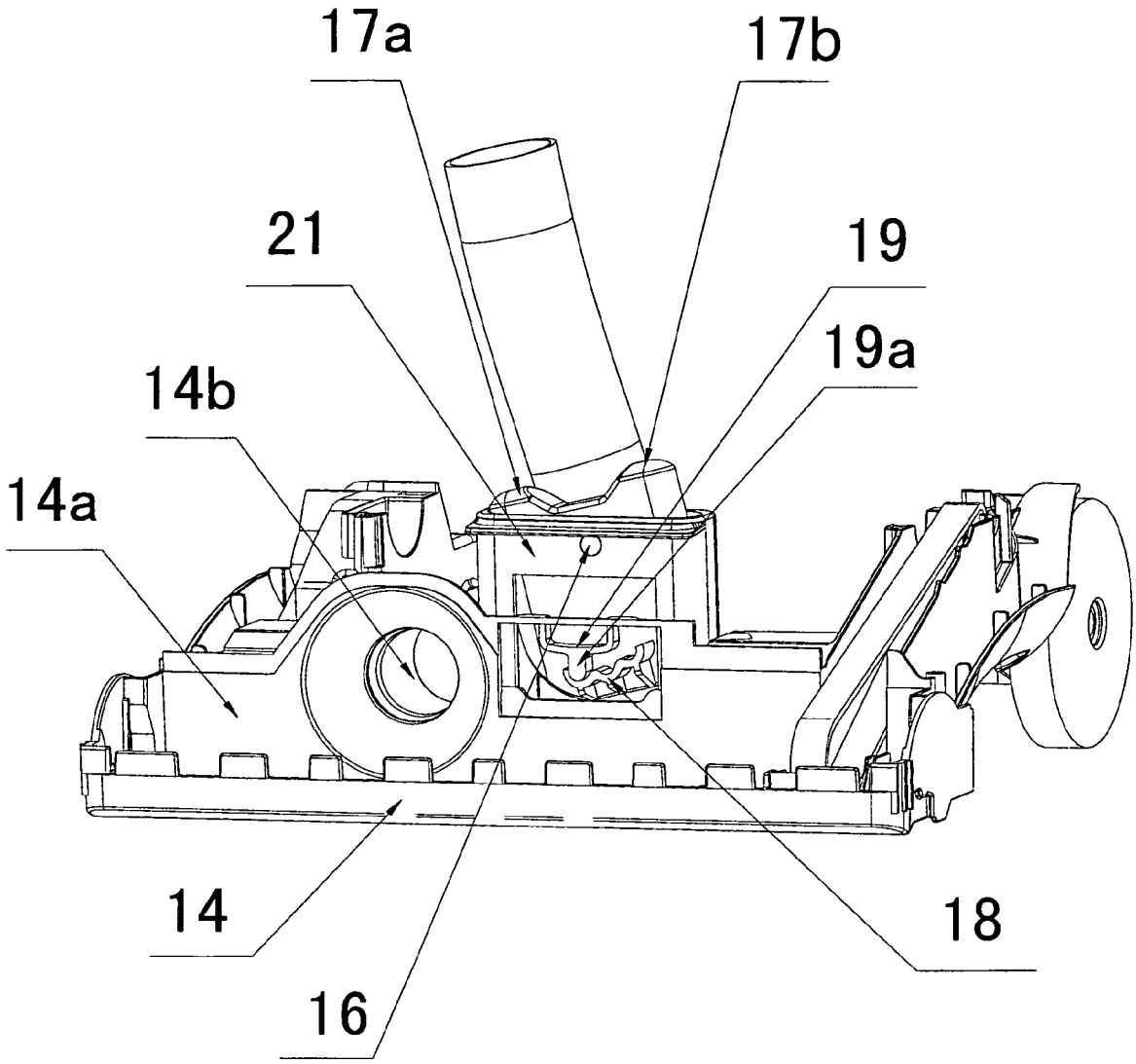
FIG. 11 is a perspective view of another embodiment of the height adjusting apparatus; (the cover of the suction nozzle and part of the clapboard were removed)
Figure 12:
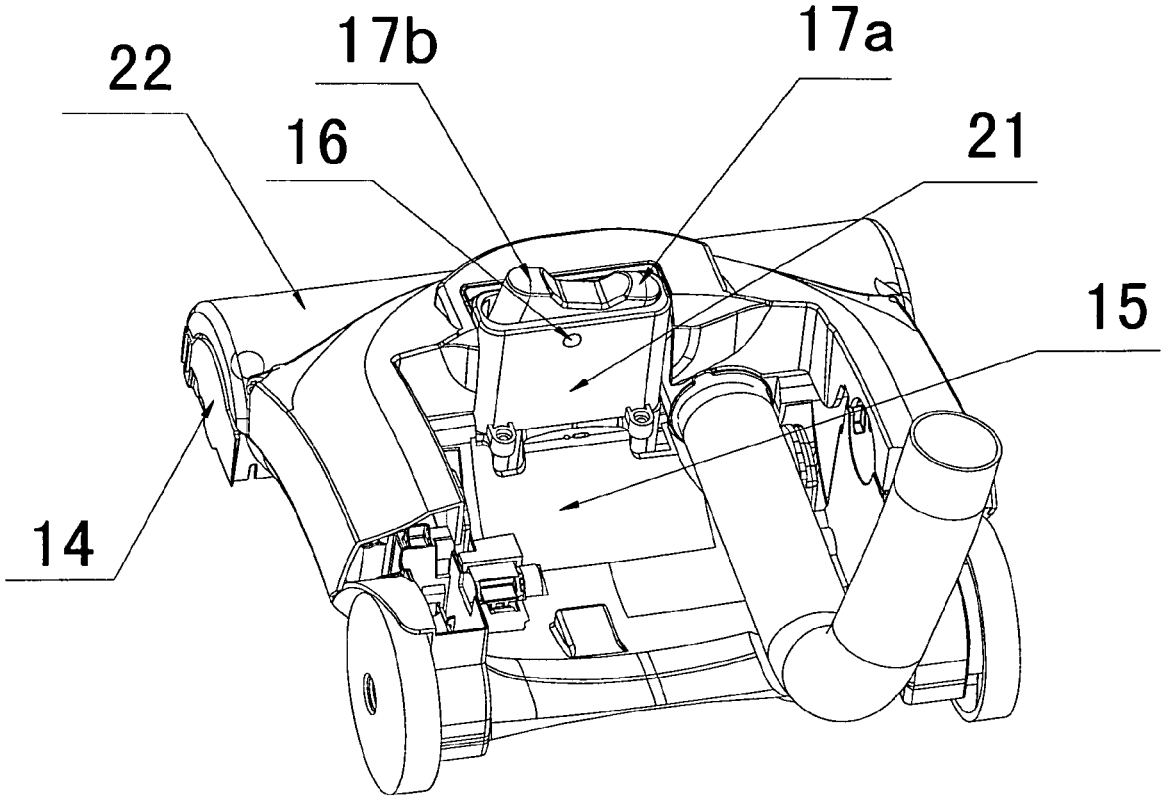
FIG. 12 is the rear view of FIG. 11.
Figure 13:
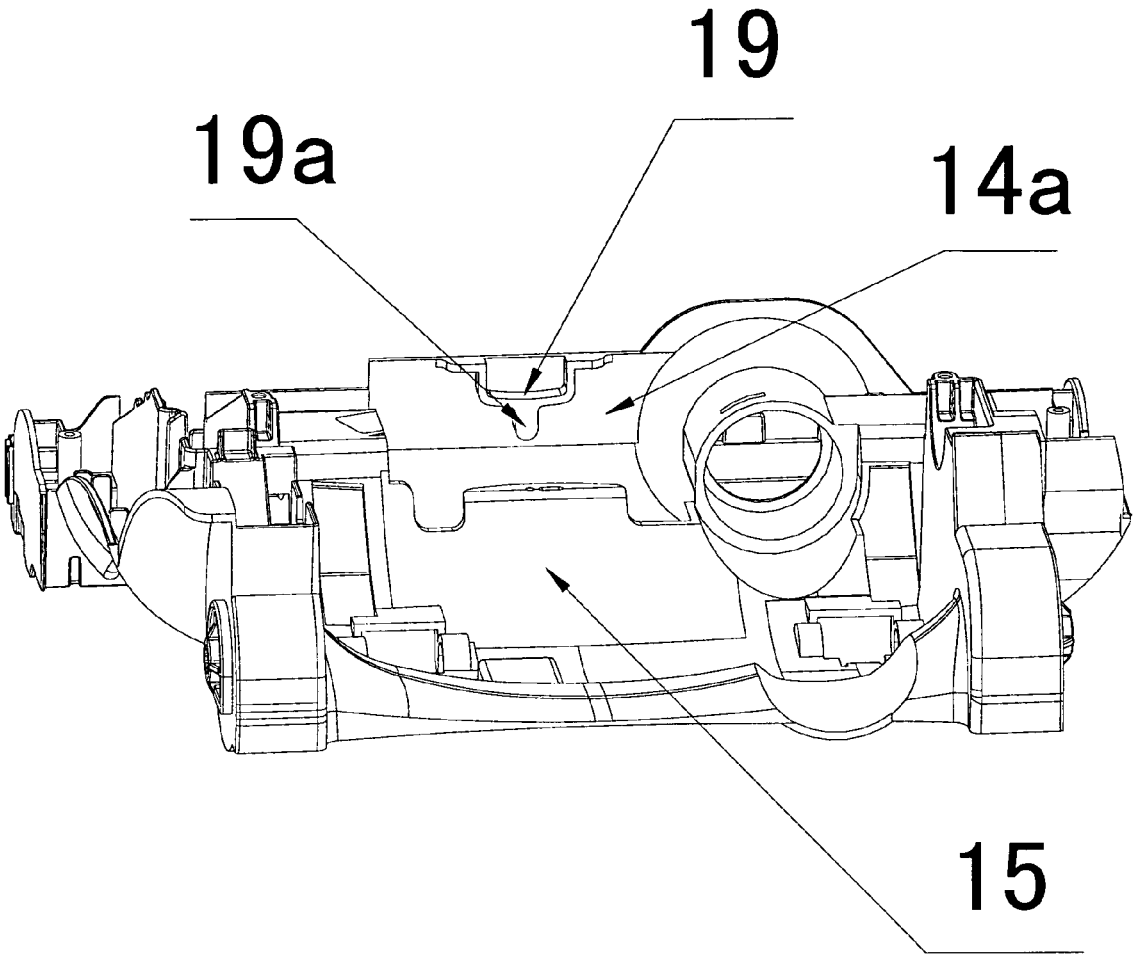
FIG. 13 is the rear view of FIG. 11; (the cover of the suction nozzle, part of the clapboard and swing member were removed)

In accordance with FIG. 10, FIG. 11, FIG. 12 and FIG. 13, a clapboard 14*a* is formed on the chassis 14 with a suction hole 14*b* connected with the suction tube of a vacuum, the brush chamber is disposed in front of the clapboard securing the brush, as shown in FIG. 13, said intermediate member 19 is formed behind the clapboard, said intermediate member 19 having a salient 19*a* extending downwardly that could be stuck in one of the concaves of the corrugated plate 17, i.e. without applying force (for example: press by foot) to the swing body 17, the swing body 17 keeps stable because of the effect of the concave exerting to the salient 19*a*.

Figure 10:
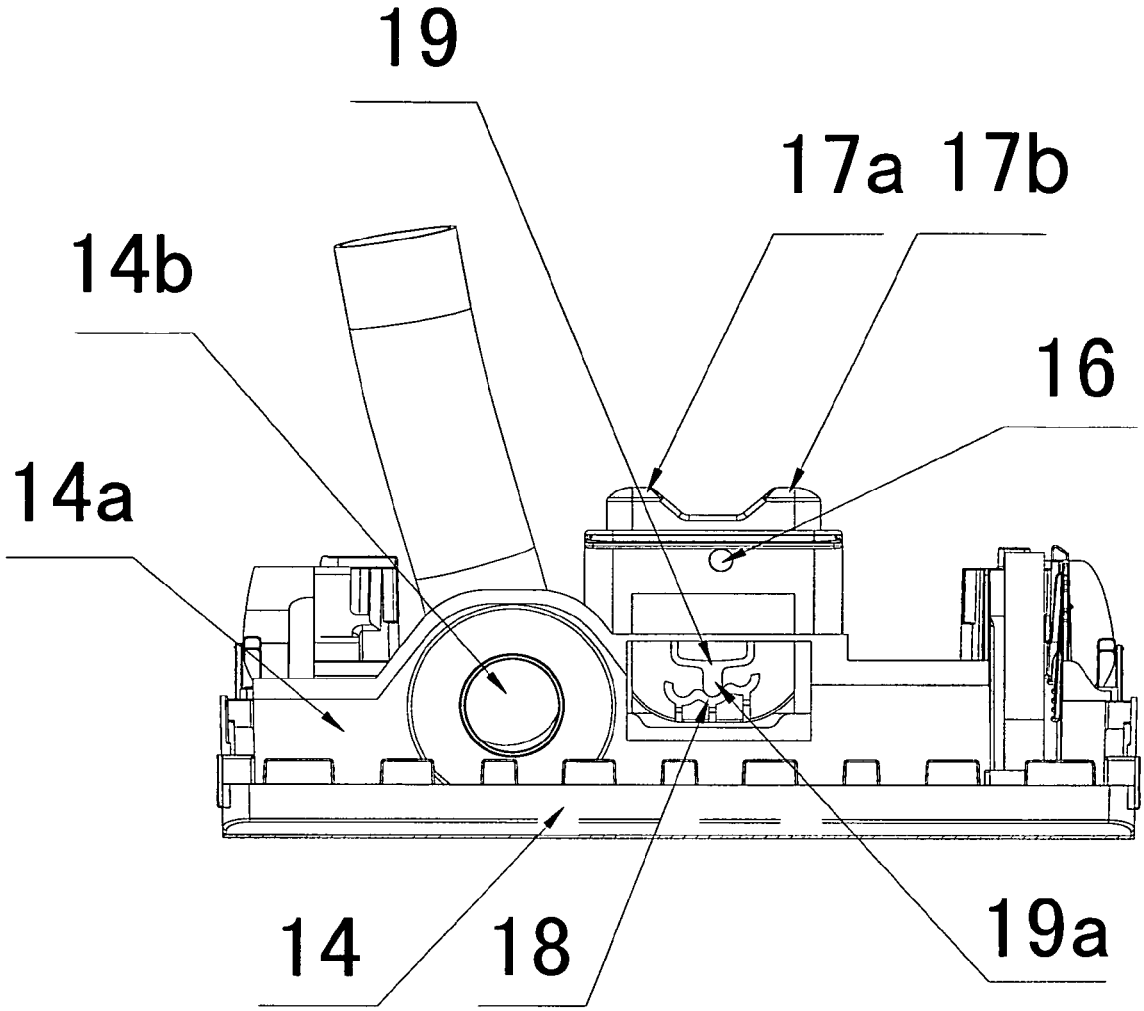
FIG. 10 is a front view of another embodiment of the height adjusting apparatus; (the cover of the suction nozzle and part of the clapboard were removed)

The press part 17*a*, 17*b* of the swing body 17 protruding upward from the opening of the limiter 21, as shown in FIG. 10, FIG. 11 and FIG. 12. The limiter is provided with an opening corresponding to the corrugated plate 18 of the swing body 17, so as to enable the corrugated plate protruding from limiter 21 coordinating with the intermediate member 19, as shown in FIG. 10, FIG. 11; FIG. 10 and FIG. 11 illustrates the relationship between corrugated plate 18 and the intermediate member 19.

The working principle of this embodiment is as follow: when an external pressure is applied to the press part 17*a*, 17*b* of said swing body, the corrugated plate 18 is swung around the pivot 16 along with the swing body 17 to jostle the salient 19*a* of the intermediate member 19 from a certain concave into the next concave. Because of the height difference between two adjacent concaves, the salient is repositioned in vertical direction; the intermediate member 19 is formed on the chassis 14, the reposition of the intermediate member 19 will leads to the reposition of the brush in vertical direction. FIG. 10 shows the salient 19*a* of the intermediate member 19 stuck in a concave of the corrugated plate, when a pressure force is applied to the press part 17*a* of the swing body 17, the swing body 19 is inclined to right, and the salient 19*a* is jostled into the left concave consequently, as shown in FIG. 11. Due to the left concave dispose below the right concave, the intermediate member descends, and the brush descends consequently; in the same way, when a pressure force is applied to the right press part 17*b* of the swing body 17, the brush ascends. A truckle frame 20*a* is fixed to the plate 20, a truckle standing on the floor is secured in the truckle frame 20*a*, that help to ensure the stability of the plate 20 when operating the height adjusting apparatus.

The amount of the concaves on the corrugated plate 18 is not limited to three described in this embodiment, that depends on the actual need, for example, if the producer need a height adjusting apparatus, which can position the brush in 4, 5 or even more different heights, a corresponding amount of concaves should be added to the corrugated plate; obviously, the corrugated plate having at least two concaves.

Figure 15:
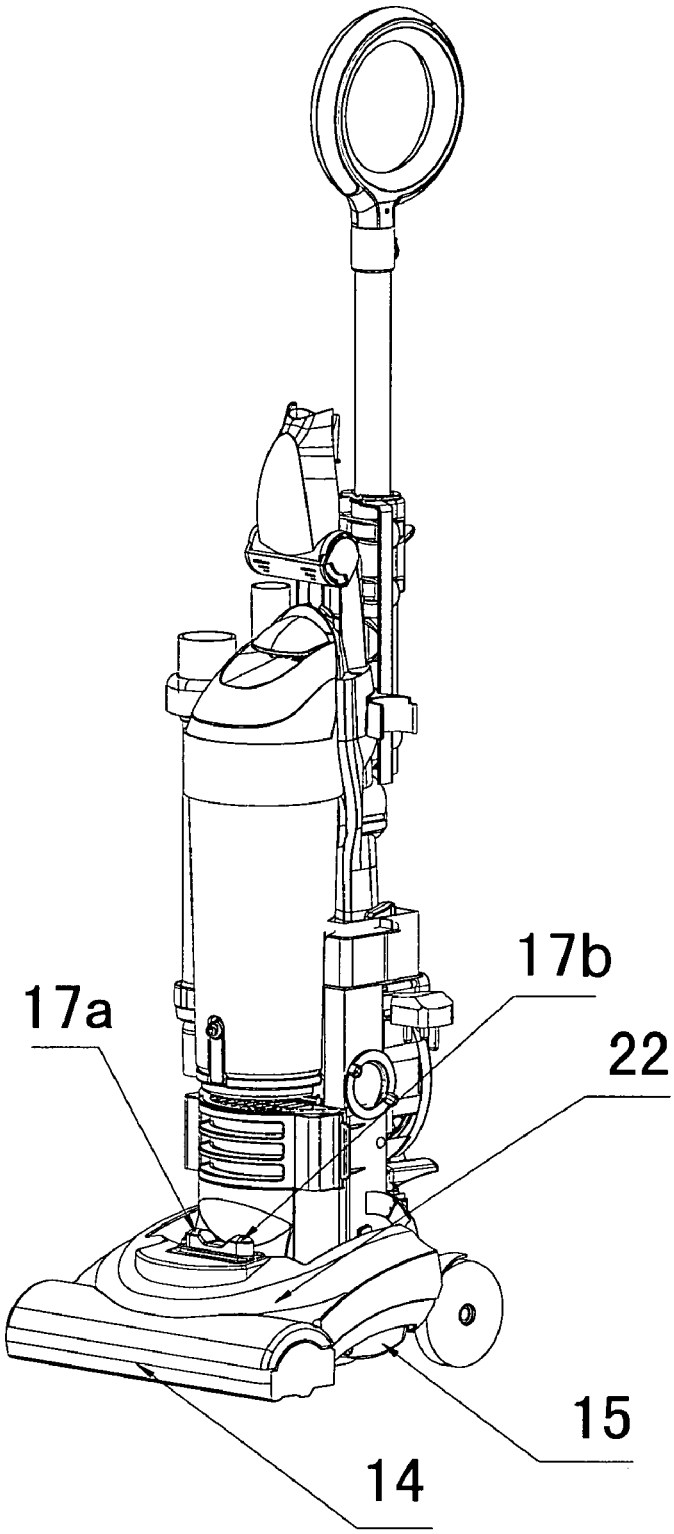
FIG. 15 is a sketch view of a vacuum with an apparatus shown in FIG. 9.

FIG. 15 illustrates a vacuum with a height adjusting apparatus having a simple structure, comprises a chassis with a suction nozzle in combination with a suction nozzle top 22, and a movable nozzle housing 15 mounted to the chassis 14; the height adjusting apparatus is mounted on the brush seat 15, the press part 17*a*, 17*b* protrude upwardly from the opening of the suction nozzle top 22, it is convenient and takes less labor and time for adjusting the height of the brush by foot pressing the press part.

The invention claimed is:

1. A vacuum cleaner nozzle comprising:

a nozzle housing (10);

a wheel carriage (10*a*) pivotally mounted to nozzle housing (10) for supporting said housing on a floor surface;

a height adjusting apparatus attached to nozzle housing (10) and comprising:

a barrel (1) attached to the truckle frame (10*a*) and having a vertical passage (2), at least one groove module (4) communicating with said vertical passage (2) and formed on an inner surface thereof, said groove module (4) having a first positioning point and a second positioning point which is different from said first positioning point in a height;

an actuator member (8,9) disposed in vertical passage, having at least one rib (8*a*,9*a*) for corresponding with the groove module (4);

a lifting member (7), which is disposed in the vertical passage (2) under the actuator member (8,9) and is adapted for lifting the nozzle housing (10); said lifting member is driven by said actuator member so as to hold the nozzle housing (10); and a resilient member (6), which is disposed under the lifting member (7) for supporting the lifting member (7);

wherein when the actuator member (8,9) moves downwardly, said rib moves (8*a*) from the first positioning point to the second point along at least a spiral path and said nozzle housing returns to its original position after a circulation by pressing the actuator member repeatedly.

2. A vacuum cleaner nozzle according to claim 1, characterized in that said barrel (1) is provided with at least two vertical notches communicated with the vertical passage (2) on sides thereof, and the lifting member has at least two columns (7*a*) protruding outwards through the vertical notches for supporting the nozzle housing (10).

3. A vacuum cleaner nozzle according to claim 2, characterized in that said nozzle housing (10) comprises a chassis (11) and a inner wall (11*b*) having a suction hole (11*a*), a brush chamber is formed in front of the inner wall (11*b*) and a flat frame (12) connected to the nozzle housing (10) and arranged behind the clapboard (11*b*).

4. A vacuum cleaner nozzle according to claim 3, characterized in that a cover (13) is mounted on the said flat frame (12) and envelops said barrel (1) and actuator member (8,9).

5. A vacuum cleaner nozzle according to claim 1, characterized in that the height adjusting apparatus comprising a plurality of groove modules (4), said groove modules (4) arranged symmetrically along the circumference of the vertical passage (2) and the vertical groove parts (5*a*) are of different heights.

6. A vacuum cleaner nozzle comprising:

a nozzle housing (10);

a truckle frame (10*a*) pivotally mounted to nozzle housing (10) for supporting said housing on a floor surface;

a height adjusting apparatus attached to nozzle housing (10) and comprising:

a barrel (1) attached to the wheel carriage (10*a*) and having a vertical passage (2), a first and second groove modules (4) communicating with said vertical passage (2) and formed on an inner surface thereof, said first groove module spaced from and adjacent to the second groove module;

an actuator member (8,9) disposed in vertical passage, having at least one rib (8*a*,9*a*) for corresponding with the groove modules (4);

a lifting member (7), which is disposed in the vertical passage (2) under the actuator member (8,9) and is adapted for lifting the nozzle housing (10); said lifting member is driven by said actuator member so as to hold the nozzle housing (10); and a resilient member (6), which is disposed under the lifting member (7) for supporting the lifting member (7);

wherein when the actuator member (8,9) moves downwardly, said rib moves (8*a*) from the first groove module to the second groove module and said nozzle housing returns to its original position after a circulation by pressing the actuator member repeatedly.

7. A vacuum cleaner nozzle according to claim 6, wherein said first groove module has a first positioning point, and said second groove module has a second positioning point which is different from said first positioning point in a height.

* * * * *